United States Patent [19]

Porter

[11] Patent Number: 4,909,038

[45] Date of Patent: Mar. 20, 1990

[54] CONTROL SYSTEM FOR DISPENSING A CRYOGENIC FLUID

[75] Inventor: Warren W. Porter, Escondido, Calif.

[73] Assignee: NCR Corporation, Dayton, Ohio

[21] Appl. No.: 284,649

[22] Filed: Dec. 15, 1988

[51] Int. Cl.[4] ..... F17C 7/02

[52] U.S. Cl. ..... 62/50.1; 62/50.7; 137/210

[58] Field of Search ..... 62/55, 50.1, 50.7; 137/210

[56] References Cited

U.S. PATENT DOCUMENTS

| | | | |
|---|---|---|---|
| 419,717 | 1/1890 | Scott . | |
| 2,021,390 | 11/1935 | Smith et al. | 4/70 |
| 2,218,941 | 10/1940 | Thompson | 137/20 |
| 2,245,653 | 6/1941 | Dierker | 128/227 |
| 2,346,253 | 4/1944 | De Motte | 62/50.1 |
| 2,440,738 | 5/1948 | Cooper | 62/50.1 |
| 2,487,863 | 11/1949 | Garretson | 62/55 |
| 2,502,211 | 3/1950 | Dyer | 137/21 |
| 2,800,134 | 7/1957 | Merritt | 134/168 |
| 2,895,305 | 7/1959 | Reed | 62/55 |
| 2,973,629 | 3/1961 | Lady | 62/55 |
| 3,106,071 | 10/1963 | Green et al. | 62/50.1 |
| 3,491,788 | 1/1970 | Kilayko | 137/218 |
| 3,537,271 | 11/1970 | Montag | 62/55 |
| 3,710,584 | 1/1973 | Leonard | 62/55 |
| 4,583,372 | 4/1986 | Egan et al. | 62/50.1 |
| 4,592,382 | 6/1986 | Rubin et al. | 137/218 |
| 4,667,478 | 5/1987 | Jones, III | 62/55 |
| 4,744,222 | 5/1988 | Murai | 62/55 |

*Primary Examiner*—Ronald C. Capossela

*Attorney, Agent, or Firm*—Wilbert Hawk, Jr.; Stephen F. Jewett; Jack R. Penrod

[57] ABSTRACT

A simple, inexpensive and reliable dispensing system for a cryogenic fluid is presented. The system controls the dispensing of a cryogenic liquid, such as liquid nitrogen, from a large, well insulated reservoir to a cooling enclosure for an electronic circuit or similar enclosure. In order to prevent a considerable heat influx from the environment to a standing cryogenic fluid through long lengths of insulated conduit between the main, well insulated reservoir and the enclosure, the system fills an intermediate reservoir and subsequently drains most of the long lengths of insulated conduit into the intermediate reservoir by a siphon action. The intermediate reservoir is well insulated and holds enough cryogenic fluid to fulfill the requirements of the cooling enclosure for long periods of time before refill from the main reservoir is necessary. Control of the fluid delivered to the intermediate reservoir may either be perform manually, since the reservoir has a float valve that prevents over filling, or automatically. Automatic control requires a level sensor which automatically turns off the flow from the main reservoir and siphons the cryogenic conduit into the intermediate reservoir.

8 Claims, 6 Drawing Sheets

CONTROL SYSTEM FOR DISPENSING A CRYOGENIC FLUID

BACKGROUND OF THE INVENTION

The present invention relates to a liquid level control system, and more particularly to a system for controlling the level and pressure of a cryogenic fluid that is dispensed from a main reservoir to a cooling enclosure.

A very simple liquid level control is shown in U.S. Pat. No. 4,745,760 by the present inventor which issued May 24, 1988. This patent is commonly assigned to NCR Corporation, which has its headquarters located in Dayton, Ohio, and the disclosure of this patent is hereby incorporated by reference. The fluid flow system described in this patent is essentially a free flow, static system in which the level of fluid in a main reservoir equalizes with the level of fluid in the cooling enclosure according to Pascal's law. However, since the gaseous evaporated fluid is partially restricted from leaving the cooling enclosure in order to guide it back into the outer portion of the fluid transfer conduit, a slight back pressure exists in the cooling enclosure which causes its fluid level to be slightly lower than the fluid level in the main reservoir. This simple system has no provision for filling the main reservoir to a level substantially above that of the cooling enclosure, or for turning off the flow of the cryogenic fluid from the main reservoir to the cooling enclosure should that be necessary.

Turning off the flow of the cryogenic fluid is not a minor task. Cryogenic conduits, such as the ones described in the above referenced patent, have greater heat losses than well insulated reservoirs or enclosures. This fact, coupled with the fact that a cryogenic fluid expands tremendously when its temperature reaches the vaporization point, clearly indicates that some provision must be made to clear the conduit of the cryogenic fluid before it vaporizes whenever the fluid supply from the main reservoir is turned off.

The capability to turn off the flow of the cryogenic fluid is an important one because it simplifies the task of filling or changing the main reservoir. The capability to turn off the flow of the cryogenic fluid also allows for maintenance or protracted inactivity of the system.

As mentioned above, the cryogenic fluid vaporizes if left in the cryogenic conduit. Vaporization would create a marked increase of the pressure within the cryogenic conduit which would require a pressure relief of some sort. Simply draining the conduit into a waste receptacle is a considerable waste of energy. Further, draining the conduit back into the main reservoir risks the introduction of heat and contamination into the main reservoir. Contamination, especially oxygen from the atmosphere, can be particularly dangerous. Oxygen liquifies at cryogenic temperatures and, since it has a different density than liquid nitrogen or liquid helium, collects in the system. Liquid nitrogen and liquid helium are relatively inert chemically, but liquid oxygen may explode into flame upon contact with an oxidizable material.

It is an object of this invention to provide a system for controlling the dispensing of a cryogenic fluid from a well insulated main reservoir to an insulated component mounting enclosure.

It is another object of this invention to provide a system for controlling the dispensing of a cryogenic fluid from a main reservoir to an insulated component mounting and for controlling the draining of a cryogenic conduit into a control reservoir after the main reservoir flow is turned off.

It is another object of this invention to provide a device for reducing the contamination of the cryogenic fluid drained into the control reservoir after the main reservoir flow is turned off.

SUMMARY OF THE INVENTION

Briefly stated, in accordance with one aspect of the invention, the foregoing objects are achieved by providing a cryogenic fluid control system for transferring cryogenic fluid from a main reservoir, including an intermediate reservoir for insulated storage of a cryogenic fluid, a control valve connected to the intermediate reservoir for controlling the amount of cryogenic fluid stored therein, and a cryogenic conduit connected to the control valve at one end and to the main reservoir at another end for transferring cryogenic fluid to the intermediate reservoir under the control of the control valve.

In another embodiment of the invention, the aforementioned objects of the invention are achieved by providing a cryogenic fluid control system for transferring cryogenic fluid from a main reservoir having an ON/OFF valve, including: a first cryogenic conduit connected to the ON/OFF valve for conveying cryogenic fluid out from the ON/OFF valve, a siphon valve connected to the first cryogenic conduit for conveying the cryogenic fluid from the ON/OFF valve, a second cryogenic conduit for conveying the cryogenic fluid from the siphon valve, an intermediate reservoir for insulated storage of the cryogenic fluid, and a control valve for controlling the amount of cryogenic fluid conveyed into the intermediate reservoir from the second cryogenic conduit. The elements of the system cooperate such that when the ON/OFF valve is in the OFF position the cryogenic fluid remaining within the second conduit by the operation of the siphon valve is conveyed under the control of the control valve to the intermediate reservoir. From the intermediate reservoir, the cryogenic fluid is dispensed to an insulated component mounting enclosure. The insulated component mounting enclosure has its own level control valve which controls the level of cryogenic fluid therein.

BRIEF DESCRIPTION OF THE DRAWINGS

While the specification concludes with the appended claims particularly pointing out and distinctly claiming the subject matter which is regarded as the invention, it is believed that the invention will be better understood from the following description of the illustrative embodiment taken in conjunction with the accompanying drawings in which:

DETAILED DESCRIPTION OF A PREFERRED EMBODIMENT

Figure 1:
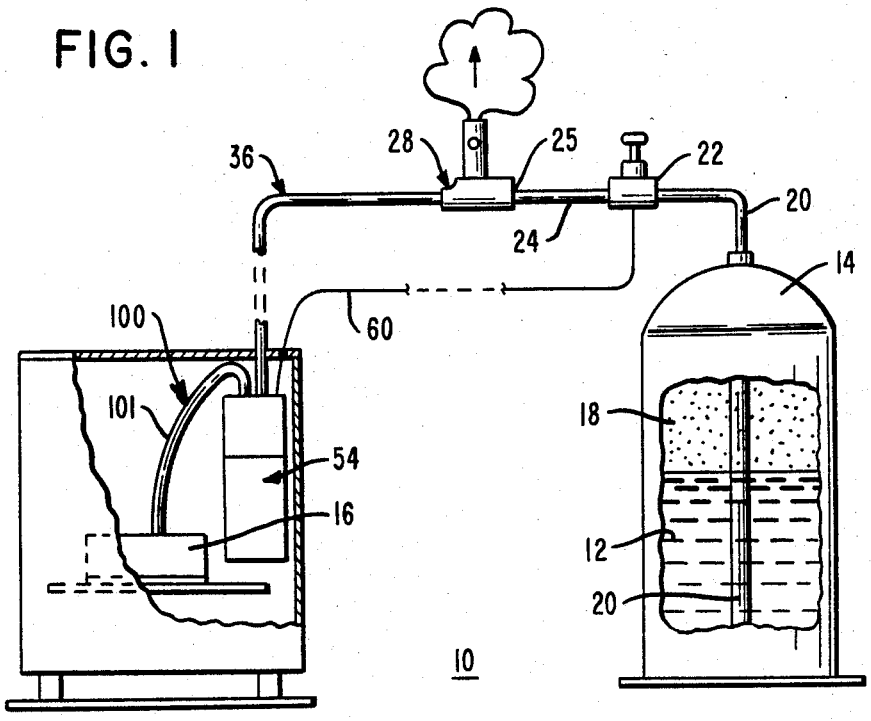
FIG. 1 is a partially broken away front view of one embodiment of the invention.

Referring to FIG. 1, a control system 10 is shown for dispensing a cryogenic liquid 12 from an insulated main reservoir 14 into a cooling component mounting enclosure 16 in accordance with an embodiment of the present invention. Cryogenic liquid 12 may be any of various liquids, but relatively inert liquefied gases such as liquid nitrogen or liquid helium are preferred. Main reservoir 14 is sealed such that the evaporated gases 18 from cryogenic liquid 12 build up a pressure therein of approximately 22 pounds per square inch.

Pipe 20 extends from the bottom of insulated main reservoir 14 within cryogenic liquid 12 to the top thereof where pipe 20 attaches to ON/OFF valve 22. ON/OFF valve 22 may be manually actuated, electrically operated, or a series combination of both. Pipe 20 and ON/OFF valve 22 are allowed to "self-insulate" with a build-up of frost and ice. This build-up is acceptable at this point in order to allow operator access to the manual actuator of ON/OFF valve 22 for system maintenance. ON/OFF valve 22 is further connected to one end of pipe 24. Pipe 24 is well insulated to prevent heat entry into the remainder of the system and to prevent frost/ice build-up on the remainder of the system.

Figure 2:
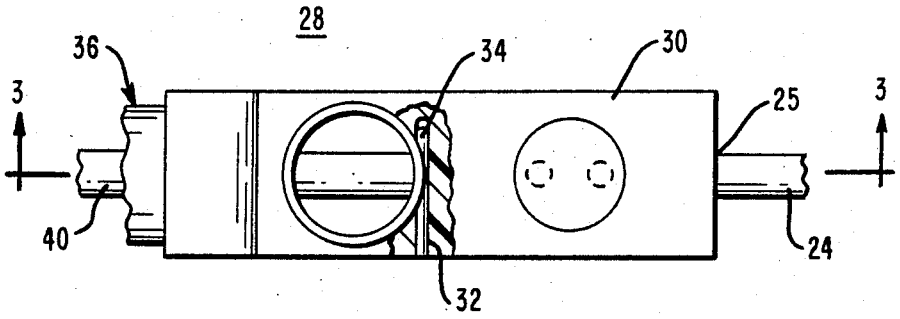
FIG. 2 is a plan view of a siphon valve, according to one embodiment of the invention, which is partially broken away to show a retaining pin.
Figure 3:
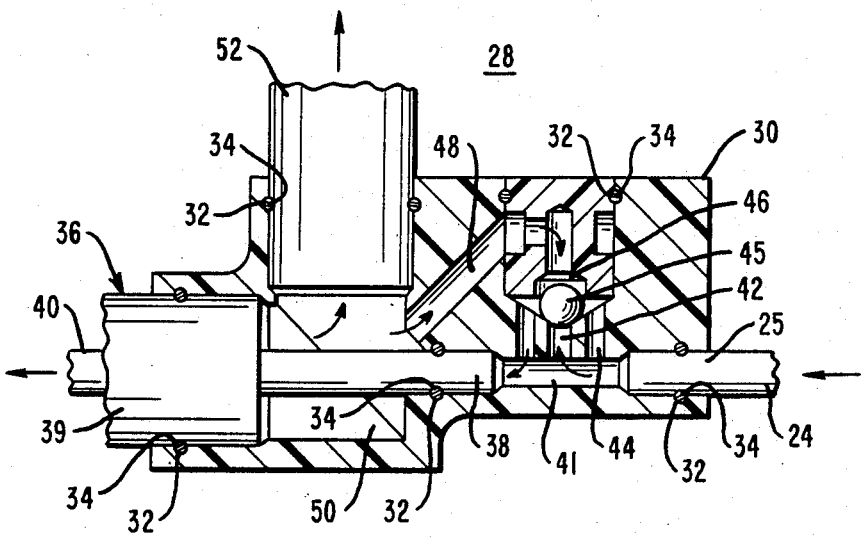
FIG. 3 is a section view of the siphon valve along line 3—3 in FIG. 2.

Turning now to FIGS. 2 and 3, a second end 25 of pipe 24 is shown connecting to siphon valve mechanism 28. Siphon valve mechanism 28 has a body 30 which is made from a fluorocarbon polymer, such as a tetrafluoro-ethylene polymer, because of this material's ability to retain flexibility at cryogenic temperatures. Body 30 has a number of holes 32, usually grouped in pairs, for receiving metal pins 34 of steel, brass, or similar material. These pins 34 are used for retaining items which are inserted into body 30 such as second end 25 of pipe 24. Pins 34 increase the friction between body 30 and the inserted item, such as second end 25, at standard temperatures and, thereby, secure the inserted items from pulling loose from body 30. And, as the temperature of body 30 decreases, the fluorocarbon polymer contracts and presses pins 34 even tighter against the inserted items, thereby increasing the securing force at pins 34 more.

Siphon valve mechanism 28 has cryogenic conduit 36 inserted into body 30 at an end opposite from pipe 24. Cryogenic conduit 36 has an outer conduit 39 and an inner conduit 40 which are similar in material and construction to the cryogenic conduit shown in U.S. Pat. No. 4,745,760 mentioned previously. First end 38 of the inner conduit 40 is secured in a channel 41 opposite end 25 of pipe 24. Channel 41 provides a path for the cryogenic liquid 12 to flow from pipe 24 into inner conduit 40.

Valve channel 42 and siphon passages 44 communicate with channel 41 for operating the siphon valve 45 as will be explained. When ON/OFF valve 22 (see FIG. 1) is ON, the pressure of the cryogenic liquid 12 flowing in valve channel 42 and siphon passages 44 will force valve 45 up against seat 46 preventing any cryogenic liquid 12 from flowing further therein. When ON/OFF valve 22 is OFF, the pressure of the cryogenic liquid 12 flowing in valve channel 42 and in siphon passages 44 drops and the valve 45 moves from seat 46 down to the top of valve channel 42. When the valve 45 moves down, a path 48 opens to a chamber 50, which is filled with evaporated gases 18 as will be explained below. This path 48 allows the cryogenic liquid 12 in inner conduit 40 and in channel 41 to siphon down the cryogenic conduit 36.

The outer conduit 39 conveys evaporated gases 18 of the cryogenic liquid 12 from the remainder of the system 10. Outer conduit 39 is inserted into body 30 and secured there by pins 34 in a manner similar to the securing of inner conduit 40. Outer conduit 39 communicates with chamber 50 such that chamber 50 is filled with evaporated gases 18 from the remainder of the system 10. Filling chamber 50 with evaporated gases 18 achieves two important objectives. First, since the evaporated gases 18 do not contain any humidity, frost or ice will not form on the inside of chamber 50, path 48 or valve seat 46. Such ice or frost formation may defeat the operation of the siphon valve mechanism 28. Second, since evaporated gases 18 are chemically the same as cryogenic liquid 12 already circulating in the system 10, potentially corrosive or explosive oxidizers, such as liquefied oxygen, are prevented from entering during siphon operation. To help keep the chamber 50 filled with pure evaporated gases 18, an exhaust stack 52 is inserted and secured into the body 30. Stack 52 locates the position where the evaporated gases 18 mix with the atmosphere some distance away from the chamber 50, thereby keeping the evaporated gases 18 in chamber 50 pure.

Figure 4:
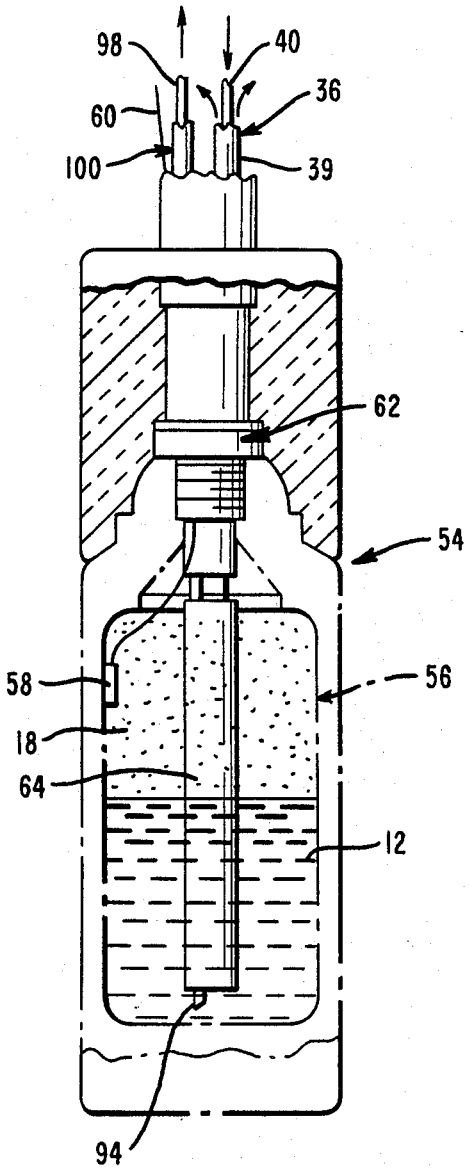
FIG. 4 is a front view of an intermediate insulated reservoir, according to one embodiment of the invention, which is partially broken away to show its internal arrangement.

Referring now to FIG. 4, cryogenic conduit 36 is shown terminating at intermediate reservoir assembly 54. The intermediate reservoir assembly 54, as its nomenclature implies, is located and connected between main reservoir 14 and component mounting enclosure 16, but in a closer proximity to component cooling enclosure 16 (see FIG. 1) than main reservoir 14.

Intermediate reservoir assembly 54 has a well insulated reservoir 56, such as a vacuum bottle or Dewar, similar to main reservoir 14 (not shown in FIG. 4), except that it is smaller and operates at a lower internal pressure. Insulated reservoir 56 has a level sensor 58, such as a thermocouple or thermistor, which transmits a control signal on control conductor 60 when the level of cryogenic liquid 12 reaches a predetermined level, which will be explained below. The filling of insulated reservoir 56 is controlled by lower valve assembly 62, float 64 and level sensor 58.

Figure 6A:
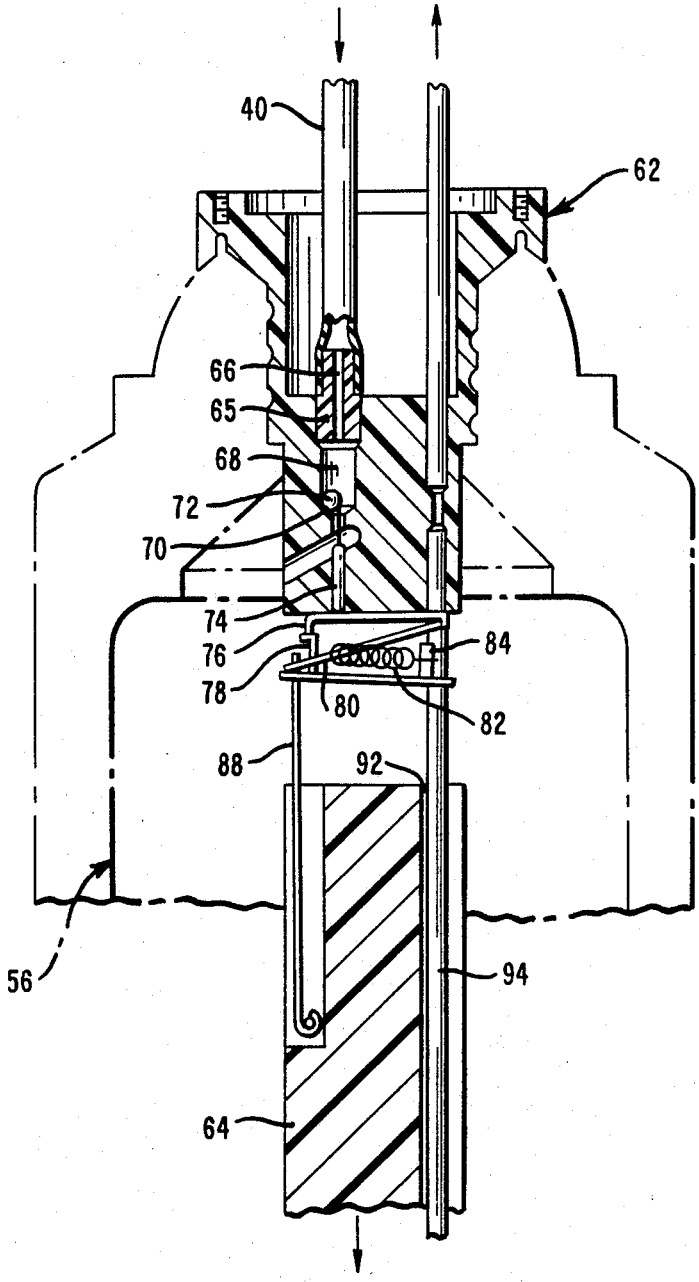
FIG. 6A is a partial section view taken along line 6A—6A of FIG. 5 showing the control valve assembly portion in the valve-open position.

Referring now to FIG. 6A, a cross section of lower valve assembly 62 is shown in the fill position. Inner conduit 40 is connected to standoff 65, which has a channel 66 therein for conveying cryogenic liquid 12 into valve chamber 68. Valve seat 70 is formed in the bottom of the valve chamber 68. Valve ball 72 normally seats against valve seat 70 by the force of gravity and of the pressurized liquid flow, unless it is displaced by control rod 74. As seen in FIG. 6A, when control rod 74 is in the up position, valve ball 72 is displaced and any liquid in inner conduit 40 may flow into insulated reservoir 56.

Control rod 74 moves up or down according to rocking lever 76 which is pivotably connected at one end to support 78. At the other end of rocking lever 76, one end of snap lever 80 is connected. To give snap lever 80 a snap action, spring 82 is stretchably connected between the middle of the lever 80 and post 84. At the opposite end of the snap lever 80, it is connected to one end of link member 88. The other end of link member 88 is anchored to the float 64. Float 64 has a cylindrical passage 92 therein for pipe 94 to slidably pass through. Thus, float 64 will freely slide up and down pipe 94 according to the level of cryogenic liquid 12 in the insulated reservoir 54. When the level of cryogenic liquid 12 is below the preselected minimum level, float 64, link member 88, snap lever 80, rocking lever 76, and control rod 74 assume the position shown in FIG. 6A, which is the fill position. In the fill position, the tension of spring 82 biases the snap lever 80 in the down position such that the buoyancy of the float 64 in the cryogenic liquid 12 must overcome the combination of the spring bias and inherent friction forces to snap the snap lever 80 to the closed position.

Figure 6B:
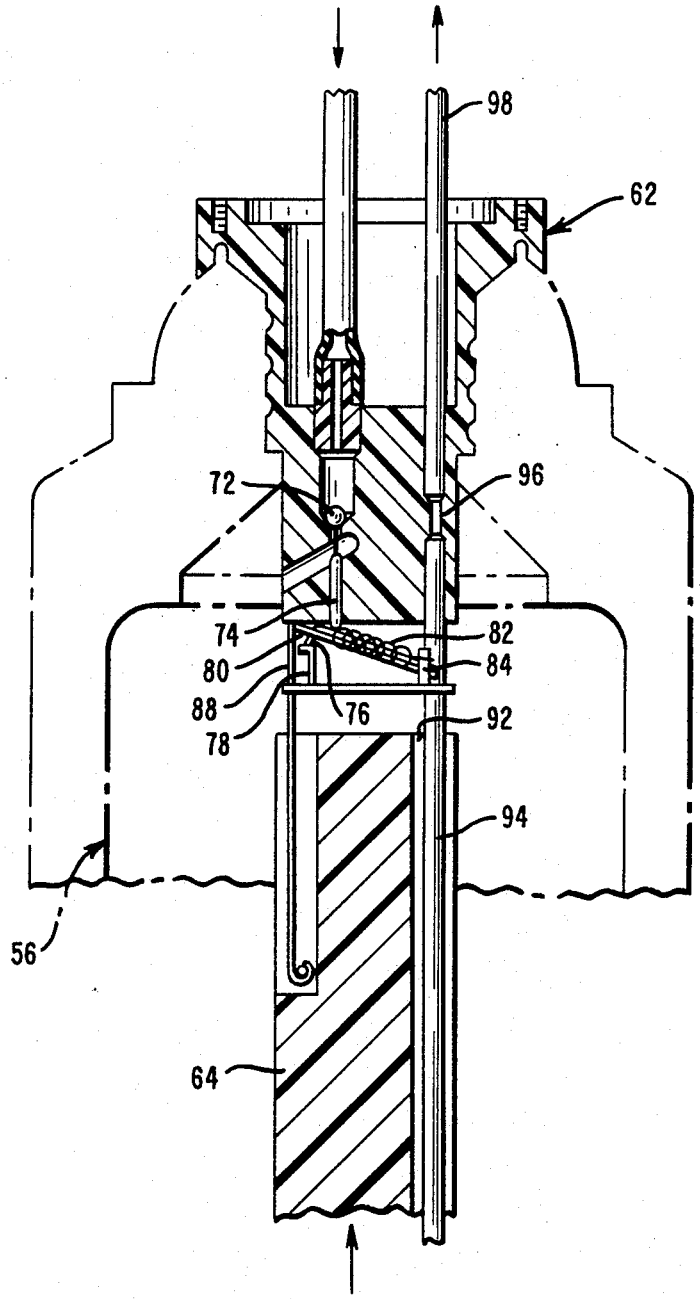
FIG. 6B is a partial section view taken along line 6B—6B of FIG. 5 showing the control valve assembly portion in the valve-closed position.

FIG. 6B shows lower valve assembly 62 after it has assumed the full or closed position. Sufficient cryogenic liquid 12 has entered insulated reservoir 56 to buoy float 64 up and overcome the bias of spring 82, as well as any friction between link member 88, snap member 80, rocker lever 76 and support member 78. The end result is that rocking lever 76 pivots downward, lowering control rod 74 and allowing valve ball 72 to seal against valve seat 70. The maximum level of the cryogenic liquid 12 within insulated reservoir 56 is attained as the valve ball 72 closes off the inflow from inner conduit 40. It should be noted that level sensor 58 at this point is located below the level of the cryogenic liquid 12.

As seen in FIG. 1 and discussed previously, ON/-OFF valve 22 is, preferably, controllable. In the preferred embodiment when the level of cryogenic liquid 12 reaches level sensor 58, sensor 58 transmits a control signal along control conductor 60 to turn the flow from the main reservoir 14 off. As mentioned above, this will lower the pressure of the cryogenic liquid 12 within siphon valve mechanism 28 and cause the siphon valve 45 to open. The opening of siphon valve 45 allows cryogenic liquid 12 in the inner conduit 40 to siphon into insulated reservoir 56 whenever the valve ball 72 is in the fill position. Therefore, the location of level sensor 58 is preselected such that after the ON/OFF valve 22 (see FIG. 1) is turned off, the insulated reservoir 56 has sufficient capacity remaining to receive all of the cryogenic liquid 12 which empties from inner conduit 40.

Referring to FIGS. 4 and 6B, the remainder of the control system for dispensing cryogenic liquid 12 from the insulated reservoir 56 will be described. Pipe 94 extends from just above the bottom of insulated reservoir 56 up to the lower valve assembly 62 where it is fastened. Pipe 94 communicates with passage 96 which in turn communicates with inner conduit 98 of cryogenic conduit 100. When the pressure of evaporated gases 18 increases sufficiently to overcome the weight of the column of cryogenic liquid 12, some of cryogenic liquid 12 is forced up pipe 94 and inner conduit 98 in a known way.

Referring back to FIG. 1, the remainder of control system 10 will be described. Cryogenic conduit 100, with inner conduit 98 therein, is connected between intermediate reservoir assembly 54 and insulated component mounting enclosure 16. As mentioned above, the cryogenic liquid 12 is forced by pressurized gases 18 to flow through inner conduit 98 of cryogenic conduit 100. The insulated component mounting enclosure 16 has some sort of control device which turns off the flow of cryogenic liquid 12 from cryogenic conduit 100 into component mounting enclosure 16 when it is filled. One such control device is shown in copending patent application by the same inventor entitled "LIQUID LEVEL CONTROL FOR A CRYOGENIC FLUID" which is commonly assigned to NCR Corporation, and is hereby incorporated by reference.

Figure 5:
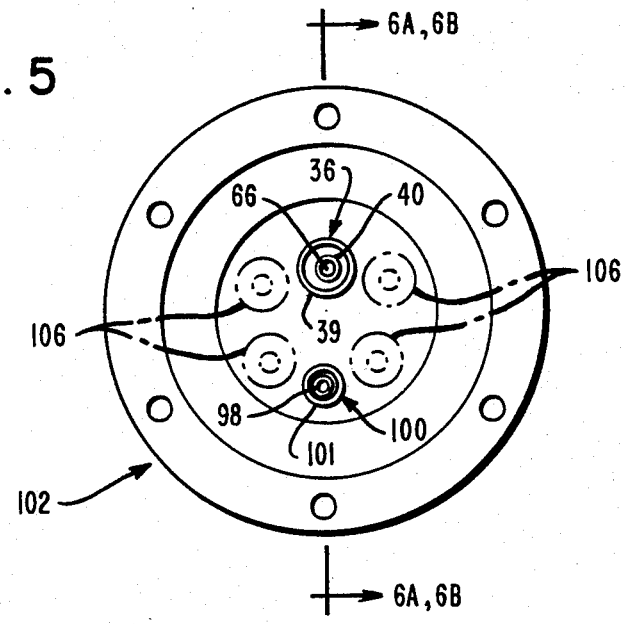
FIG. 5 is a plan view of a control valve assembly portion of the intermediate reservoir shown in FIG. 4.
Figure 7:
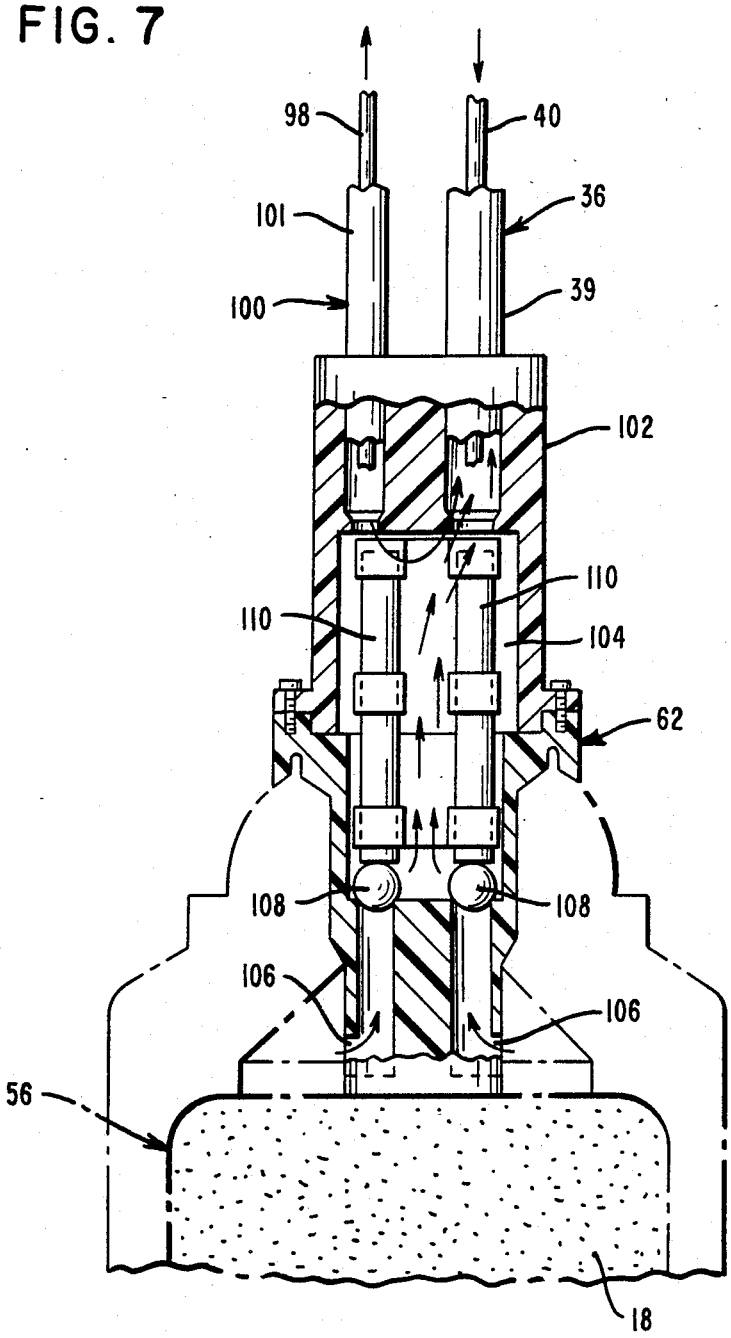
FIG. 7 is a broken away, partial side view of the control valve assembly portion showing two of its check valves for evaporated gases.

Referring now to FIGS. 5 and 7, the upper valve assembly 102 and the control of evaporated gases 18 are shown. Outer conduit 101 is connected at one end to insulated component mounting enclosure 16 (see FIG. 1) and communicates with the interior thereof to receive the evaporated gases 18 which boil off from the operating component(s) therein (not shown). Outer conduit 101 conveys the evaporated gases 18 to the upper valve assembly 102, where its second end is fastened. Upper valve assembly 102 has chamber 104 into which the evaporated gases 18 flow. Also communicating with chamber 102 are four regulator ports 106 which are formed in the lower valve assembly 62. The pressure of the evaporated gases 18 entering the chamber 104 from the insulated reservoir 56 is controlled by valve balls 108 in conjunction with force members 110, which may be weighs, springs or other such devices which increase the back pressure of the evaporated gases 18 leaving the insulated reservoir 56. Since this back pressure in insulated reservoir 56 is used to force or dispense the cryogenic liquid 12 into the insulated enclosure 16, these control valves 108 and force members 110 operate to provide that pressure. Further, since the back pressure in insulated reservoir 56 is less than the 22 psi pressure of cryogenic liquid 12 inside pipe 24, these valves 108 and force members 110 also release any excess pressure build-up, and thereby reduce the design requirements of cryogenic conduit 100 and insulated component mounting enclosure 16. Chamber 104 communicates with outer conduit 39 of cryogenic conduit 36. Outer conduit 39 conveys evaporated gases 18 to siphon valve mechanism 28 (see FIG. 3), as will be explained below.

Referring back to FIG. 3, outer conduit 39 communicates with the chamber 50 and in turn with exhaust stack 52. In this manner, pure, dry evaporated gases 18 are conveyed through chamber 50 where they are available to keep siphon valve 45 free of moisture, and to supply pure, relatively inert gas to allow the siphon action as described previously.

In operation of the preferred embodiment, valve 22 is turned to ON which conveys high pressure, i.e. 22 psi, cryogenic liquid 12 from main reservoir 14 through pipe 20 to siphon valve mechanism 28. At siphon valve mechanism 28, high pressure cryogenic liquid 12 closes siphon valve 45, and is conveyed through cryogenic conduit 36 to intermediate reservoir assembly 54. Valve 72 admits cryogenic liquid 12 into reservoir assembly 54 from the cryogenic conduit 36 until the flow is turned OFF b ON/OFF valve 22 in response to an operator, the level sensor 58, or the float 64 closing valve 72 because of the level in insulated reservoir 56. In any event, cryogenic liquid 12 is dispensed by a reduced pressure from insulated reservoir 56 through pipe 94 and cryogenic conduit 100 into insulated component mounting enclosure 16 whenever the control valve of the insulated component mounting enclosure 16 permits. Evaporated gases 18 from insulated component mounting enclosure 16 and intermediate reservoir 56 are conveyed back along their respective cryogenic conduits 100, 36 to cool the cryogenic conduits 100, 36, to provide a non-icing atmosphere for the operation of siphon valve 54, and to provide relatively inert siphon gases when line 36 siphons into intermediate reservoir 56 during a maintenance shut-down or a protracted period of inactivity.

Thus, it will now be understood that there has been disclosed a new and novel control system for dispensing a cryogenic liquid, which provides the filling of a well insulated intermediate reservoir that is closely located to a component cooling enclosure in order to greatly reduce heat absorption from the surroundings and to allow operation for considerable periods of time while disconnected from a main reservoir of cryogenic liquid.

While the invention has been particularly illustrated and described with reference to a preferred embodiment thereof, it will be understood by those skilled in the art that various changes in form, details, and applications may be made therein. It is accordingly intended that the appended claims shall cover all such changes in form, details and applications which do not depart from the true spirit and scope of the invention.

What is claimed as new and desired to be secured by Letters Patent of the U.S. is:

1. A cryogenic fluid control system for transferring cryogenic fluid from a main reservoir, comprising:

intermediate reservoir means for insulating and storing cryogenic fluid;

control valve means connected to said intermediate reservoir means for controlling the amount of cryogenic fluid within said intermediate reservoir means;

cryogenic conduit means connected to said control valve means at a first end and to said main reservoir at a second end for transferring cryogenic fluid to said intermediate reservoir means under control of said control valve;

an insulated component mounting enclosure; and second conduit means connecting said intermediate reservoir means to said insulated component mounting enclosure for transferring cryogenic fluid to said insulated component mounting enclosure.

2. The cryogenic fluid control system according to claim 1, wherein said control valve means opens for cryogenic fluid transfer if said cryogenic fluid within said intermediate reservoir means is below a lower limit, and closes if said cryogenic fluid within said intermediate reservoir means is above an upper limit thereby controlling a volume of cryogenic fluid stored in said intermediate reservoir means.

3. The cryogenic fluid control system according to claim 2, wherein said control valve means controls a pressure of said volume of cryogenic fluid within said intermediate reservoir means to a lower pressure than that pressure which is present within said main reservoir.

4. A cryogenic fluid control system for transferring cryogenic fluid from a main reservoir having an ON/-OFF valve, comprising:

first cryogenic conduit means connected to said ON/OFF valve for conveying cryogenic fluid therefrom;

siphon valve means connected to said first cryogenic conduit means for conveying cryogenic fluid from said ON/OFF valve;

second cryogenic conduit means for conveying cryogenic fluid from said siphon valve means; and intermediate reservoir means for insulating and storing cryogenic fluid;

control valve means for controlling the amount of cryogenic fluid conveyed into said intermediate reservoir means from said second cryogenic conduit means;

whereby with said ON/OFF valve in the OFF position said cryogenic fluid remaining within said second cryogenic conduit means is conveyed to said intermediate reservoir means by the operation of said siphon valve means under the control of said control valve means.

5. The cryogenic fluid control system according to claim 4, further comprising:

an insulated component mounting enclosure; and third cryogenic conduit means connecting said intermediate reservoir means to said insulated component mounting enclosure for transferring cryogenic fluid to said insulated component mounting enclosure.

6. The cryogenic fluid control system according to claim 5, further comprising:

fourth cryogenic conduit means for conveying a gaseous form of said cryogenic fluid from said insulated component mounting enclosure to said intermediate reservoir means; and fifth cryogenic conduit means for conveying said gaseous form of said cryogenic fluid from said insulated component mounting enclosure and from said intermediate reservoir means to said siphon valve means.

7. The cryogenic fluid control system according to claim 6, wherein said fourth cryogenic conduit means coaxially surrounds said third cryogenic conduit means and said fifth cryogenic conduit means surrounds said second cryogenic conduit means.

8. The cryogenic fluid control system according to claim 7, wherein said siphon valve means communicates with said fifth cryogenic conduit means when said ON/OFF valve is in the OFF position entraining said gaseous form of said cryogenic fluid from said fifth cryogenic conduit means with said cryogenic fluid that remains within said second conduit as said fluid is conveyed to said intermediate reservoir.

* * * * *